US009519248B2

(12) United States Patent
Matsusaka et al.

(10) Patent No.: US 9,519,248 B2
(45) Date of Patent: Dec. 13, 2016

(54) FIXING DEVICE INCLUDING AN INDUCTION HEATING UNIT WITH DUCTING FOR AIRFLOW, AND IMAGE FORMING APPARATUS INCORPORATING SAME

(71) Applicants: Susumu Matsusaka, Kanagawa (JP); Shota Kobashigawa, Kanagawa (JP); Motokazu Hasegawa, Kanagawa (JP); Yukari Isoe, Kanagawa (JP)

(72) Inventors: Susumu Matsusaka, Kanagawa (JP); Shota Kobashigawa, Kanagawa (JP); Motokazu Hasegawa, Kanagawa (JP); Yukari Isoe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/148,831

(22) Filed: Jan. 7, 2014

(65) Prior Publication Data

US 2014/0212191 A1 Jul. 31, 2014

(30) Foreign Application Priority Data

Jan. 30, 2013 (JP) ..... 2013-015338

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2078; G03G 15/2089
USPC ..... 399/69, 122, 320, 328, 329, 92
See application file for complete search history.

(56) References Cited

U.S. PATENT DOCUMENTS 5,283,409 A * 2/1994 Brendel ..... H05B 6/42 219/619
7,369,804 B2 * 5/2008 Yasuda ..... H05B 6/145 399/328
7,835,680 B2 * 11/2010 Nanjo ..... G03G 15/2064 219/619
2002/0003980 A1 * 1/2002 Takano ..... G03G 15/2053 399/320

(Continued)

FOREIGN PATENT DOCUMENTS

JP 2003-098896 4/2003
JP 2003-338365 11/2003

(Continued)

*Primary Examiner* — Benjamin Schmitt
*Assistant Examiner* — Matthew Miller
(74) *Attorney, Agent, or Firm* — Oblon, McClelland, Maier & Neustadt, L.L.P.

(57) ABSTRACT

A fixing device includes a rotatable fixing member, a pressing member to contact the fixing member with pressure to form a nip between the pressing member and the fixing member, an induction heating unit serving as a heating source to heat the fixing member, and a conductive wire drawn out of the induction heating unit to be disposed outside the cover member through a hole provided substantially at a center of the cover member in a longitudinal direction of the induction heating unit. The induction heating unit includes an excitation coil, a coil holder to hold the excitation coil, and a cover member provided facing the coil holder with the coil holder interposed between the cover member and the fixing member.

20 Claims, 10 Drawing Sheets

(56) References Cited

U.S. PATENT DOCUMENTS

| | | | | |
|---|---|---|---|---|
| 2004/0240898 | A1* | 12/2004 | Nonaka | H05B 6/145 399/33 |
| 2007/0041757 | A1* | 2/2007 | Tajima | G03G 15/2053 399/328 |
| 2009/0123170 | A1* | 5/2009 | Tatematsu | G03G 15/2039 399/68 |
| 2009/0245897 | A1* | 10/2009 | Seo | G03G 15/2039 399/328 |
| 2010/0054786 | A1* | 3/2010 | Hara | G03G 15/2007 399/69 |
| 2010/0247181 | A1* | 9/2010 | Chae | G03G 15/2053 399/328 |
| 2011/0097098 | A1* | 4/2011 | Tsukioka | 399/69 |
| 2011/0229170 | A1* | 9/2011 | Shimizu | 399/45 |
| 2011/0236091 | A1* | 9/2011 | Tanda | G03G 15/2007 399/330 |
| 2012/0177418 | A1* | 7/2012 | Hashiyada et al. | 399/328 |
| 2012/0219312 | A1* | 8/2012 | Yuasa | G03G 15/2039 399/69 |
| 2012/0230743 | A1 | 9/2012 | Matsusaka et al. | |
| 2013/0022381 | A1 | 1/2013 | Kawamoto et al. | |
| 2014/0119786 | A1* | 5/2014 | Ohata | G03G 15/2053 399/328 |

FOREIGN PATENT DOCUMENTS

| | | |
|---|---|---|
| JP | 2007-304315 | 11/2007 |
| JP | 2009-294398 A | 12/2009 |
| JP | 2010-197947 A | 9/2010 |
| JP | 2013-025091 | 2/2013 |

* cited by examiner

FIXING DEVICE INCLUDING AN INDUCTION HEATING UNIT WITH DUCTING FOR AIRFLOW, AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2013-015338, filed on Jan. 30, 2013, in the Japan Patent Office, the entire disclosure of which is hereby incorporated by reference herein.

BACKGROUND

Technical Field

This disclosure relates to a fixing device to fix an unfixed image on a recording medium and an image forming apparatus incorporating the fixing device.

Description of the Related Art

In fixing devices employing an induction heating system, an excessive temperature increase of excitation coils might hamper compliance of safety standards or cause disconnection of the excitation coils. In order to prevent such an excessive temperature increase, use of a cooling fan is proposed to cool down the excitation coils.

However, the temperature of the excitation coils may increase when high electric power is input. Therefore, such use of a cooling fan needs a greater output power of the cooling fan sufficiently to cool down the excitation coils, causing problems such as increases in production costs, power consumption and noise. Although use of heat insulation materials or the like may increase cooling efficiency, a configuration of a fixing device including such heat insulation materials is complicated and increases the production costs. In order to prevent such an increase in the production costs, there is a need for a configuration to increase cooling efficiency of an excitation coil without significantly changing a typical configuration of fixing device.

In an induction heating unit of the fixing device, the excitation coil is disposed facing, e.g., a fixing roller or a heating roller, over which a fixing belt is stretched, to heat the fixing roller or the heating roller. Therefore, conductive wires, such as a conductive wire of a coil thermostat and/or a conductive wire of a sensor to detect a temperature of the fixing roller, are drawn out of the induction heating unit toward a side on which the fixing roller or the heating roller is not disposed.

For example, FIG. 5 of JP-2003-338365-A illustrates a configuration in which a conductive wire is wired in a portion above an excitation coil 220, between straight parts on both sides of the excitation coil 220.

However, as illustrated in FIG. 2 of JP-2003-338365-A, the portion above the excitation coil 220 in which the conductive wire is disposed is a space between the excitation coil 220 and a unit cover, and more specifically, between arch cores 260 and a housing 270. Cooling air flows or passes through the space to cool down the excitation coil 51 in use of a cooling fan. If conductive wires of a coil thermostat and/or a temperature sensor are disposed in the space through which the cooling air passes, the conductive wires disrupt a current of the cooling air to reduce cooling efficiency.

SUMMARY

In one exemplary embodiment of the present disclosure, a fixing device includes a rotatable fixing member, a pressing member to contact the fixing member with pressure to form a nip between the pressing member and the fixing member, an induction heating unit serving as a heating source to heat the fixing member, and a conductive wire drawn out of the induction heating unit to be disposed outside the cover member through a hole provided substantially at a center of the cover member in a longitudinal direction of the induction heating unit. The induction heating unit includes an excitation coil, a coil holder to hold the excitation coil, and a cover member provided facing the coil holder with the coil holder interposed between the cover member and the fixing member.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of exemplary embodiments when considered in connection with the accompanying drawings, wherein.

Figure 1:
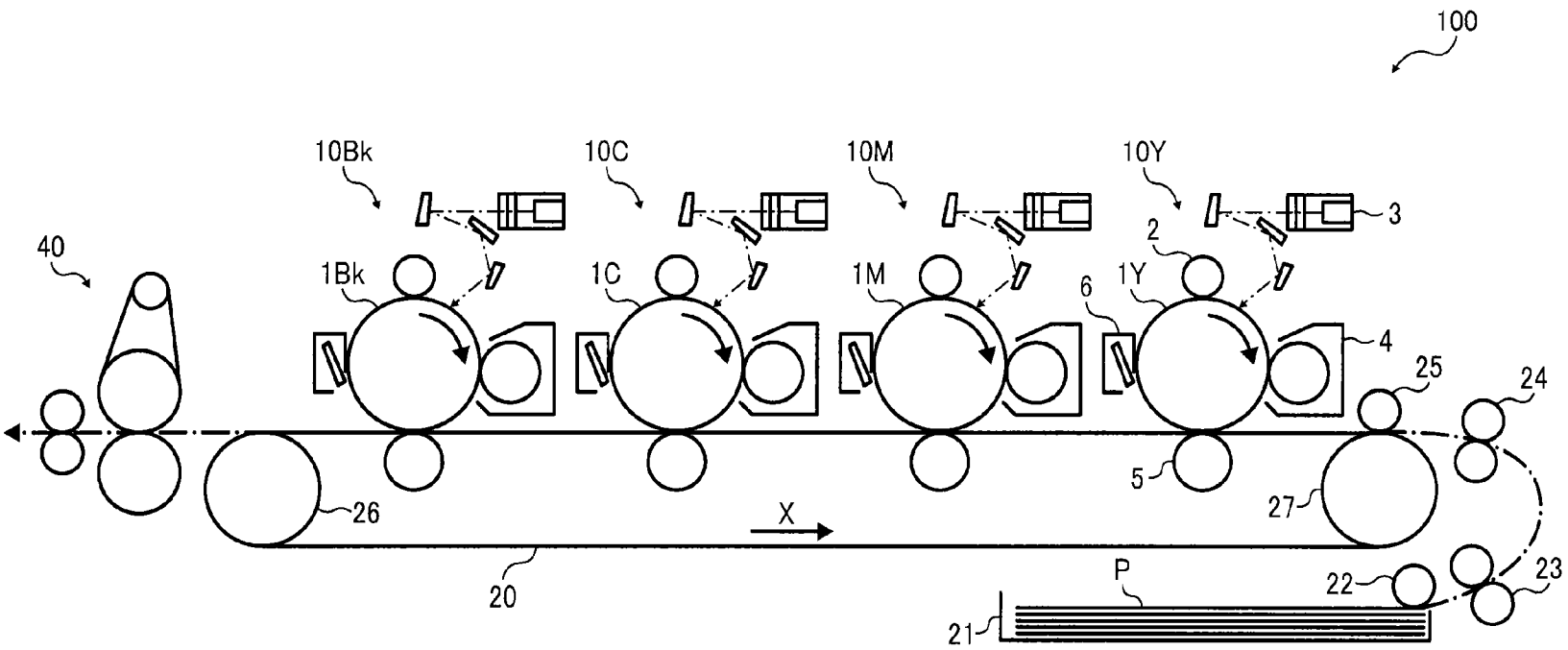
FIG. 1 is a schematic view of an example of an image forming apparatus incorporating a fixing device according to some exemplary embodiments of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF THE INVENTION

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

FIG. 1 is a cross-sectional view of an imaging part and its neighboring area of an image forming apparatus 100 incorporating a fixing device 40 according to some exemplary embodiments of this disclosure.

An entire configuration and operation of the image forming apparatus 100 are described below with reference to FIG. 1.

The image forming apparatus 100 employs an electrophotographic system. As illustrated in FIG. 1, the image forming apparatus 100 is configured as a printer including four imaging units 10Y, 10M, 10C, and 10Bk to form a full-color image by using toner of yellow (Y), magenta (M), cyan (C), and black (Bk) colors. The imaging units 10Y, 10M, 10C and 10Bk include photoconductive drums 1Y, 1M, 1C, and 1Bk, respectively, serving as image carriers, and surrounded by associated components. The configuration of the image forming apparatus 100 is not limited to the image forming apparatus 100 illustrated in FIG. 1. Although the image forming apparatus 100 of FIG. 1 employs a direct transfer method to directly transfer a toner image onto a sheet of paper (i.e., a recording medium), the image forming apparatus 100 may alternatively employ an indirect transfer method to transfer a toner image onto a sheet of paper via an intermediate transfer member. The number of colors and a sequence of colors may be appropriately changed. Further, the image forming apparatus 100 is not limited to a printer. Alternatively, the image forming apparatus 100 may be a copier, a facsimile machine, or a multifunction device having two or more of copying, printing, and facsimile functions.

As illustrated in FIG. 1, the four imaging units 10Y, 10M, 10C, and 10Bk are arranged side by side along an upper side of a conveyance belt 20 to form a tandem imaging part. The conveyance belt 20 is stretched over a driving roller 26 and a driven roller 27 to rotate in a direction indicated by an arrow X in FIG. 1. A sheet tray 21 is disposed below the conveyance belt 20 to accommodate a sheet P serving as a recording medium. The sheet P fed by a sheet-feeding roller 22 is conveyed by a pair of conveyance rollers 23 and a pair of conveyance rollers 24 while being guided by a guide member. The sheet P thus conveyed is sent onto the upper side of the conveyance belt 20 through a receiving part at which a bias roller 25 faces the driven roller 27, and then electrostatically attached to and further conveyed by the conveyance belt 20. Toner images are sequentially transferred from the imaging units 10Y, 10M, 10C, and 10Bk of the tandem imaging part onto the sheet P conveyed by the conveyance belt 20. The sheet P carrying the unfixed toner images is sent to the fixing device 40 from the conveyance belt 20. In the fixing device 40, the toner images are fixed onto the sheet P under heat and pressure.

Each of the four imaging units 10Y, 10M, 10C, and 10Bk has the same basic configuration, differing only in the color of toner used. Hence, a description is herein given only of the imaging unit 10Y, which is located at a most upstream end in a direction of conveyance of the sheet P, as a representative example of the imaging units 10Y, 10M, 10C, and 10Bk. It is to be noted that the suffix Y attached to each reference numeral and indicating the color is omitted in the following description. Additionally, reference numerals of components of each of the imaging units 10M, 10C, and 10Bk are omitted in FIG. 1 for simplicity.

The imaging unit 10 includes the photoconductive drum 1 to contact the conveyance belt 20 while rotating. The photoconductive drum 1 is surrounded by associated components, such as a charging device 2, an exposure device 3, a development device 4, a transfer roller 5, a cleaner 6, and a charge neutralizing device, disposed sequentially along a direction of rotation of the photoconductive drum 1. The charging device 2 charges a surface of the photoconductive drum 1 to a predetermined potential. The exposure device 3 exposes the charged surface of the photoconductive drum 1 with light according to an image signal after color separation to form an electrostatic latent image on the surface of the photoconductive drum 1. The development device 4 develops the electrostatic latent image thus formed on the surface of the photoconductive drum 1 with toner to form a toner image. The transfer roller 5 serving as a transfer device transfers a toner image thus developed onto the sheet P conveyed via the conveyance belt 20. The cleaner 6 removes residual toner remaining on the surface of the photoconductive drum 1 after a transfer process. The charge neutralizing device removes residual charge from the surface of the photoconductive drum 1.

The following describes the fixing device 40 according to some exemplary embodiments in detail by referring to the drawings.

Figure 2:
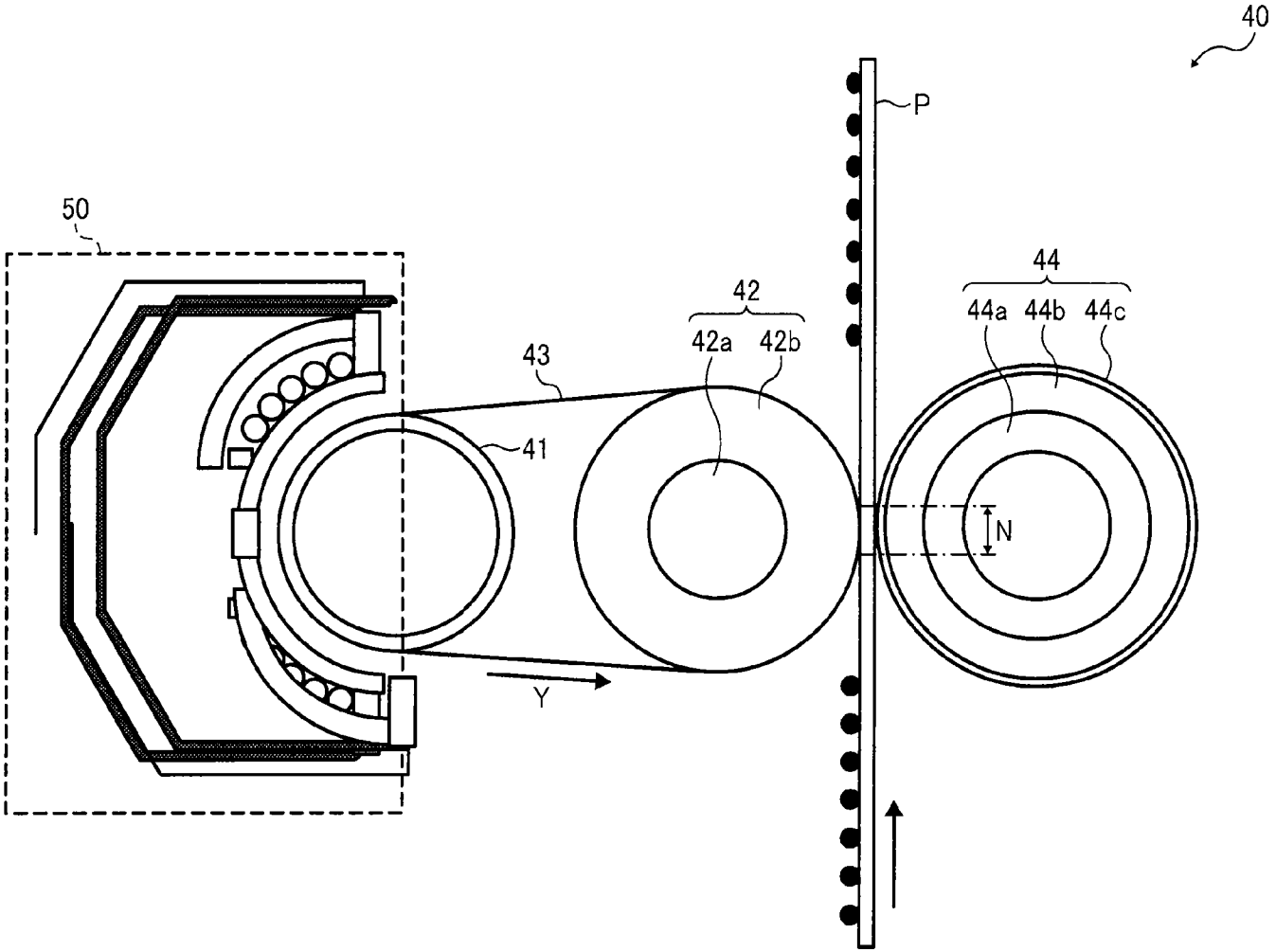
FIG. 2 is a cross-sectional view of the fixing device according to some exemplary embodiments of this disclosure.

FIG. 2 is a cross-sectional view of a fixing device 40 employing an induction heating system according to some exemplary embodiments of this disclosure.

The fixing device 40 can be used as the fixing device 40 of the image forming apparatus 100 illustrated in FIG. 1. As illustrated in FIG. 2, the fixing device 40 includes, e.g., a heating roller 41, a fixing roller 42, a fixing belt 43, a pressing roller 44, and an induction heating unit 50.

The heating roller 41 includes nonmagnetic stainless steel and has a metal core of a thickness of from about 0.2 mm to about 1 mm. A surface of the metal core of the heating roller 41 is covered by a heat generating layer. The heat generating layer includes copper and has a thickness of from about 3 μm to about 15 μm to increase heat generating efficiency. A surface of the heat generating layer is preferably nickel-plated to prevent rust. Alternatively, the heating roller 41 may include a magnetic shunt alloy having a Curie point of from about 160° C. to about 220° C. In such a case, the magnetic shunt alloy may be used as a heat generating layer or a surface of the magnetic shunt alloy may be covered by a heat generating layer made of copper and having a thickness of from about 3 μm to about 15 μm. An aluminum member is disposed inside the magnetic shunt alloy to stop temperature increase around the Curie point.

The fixing roller 42 includes a metal core 42*a* and an elastic member 42*b*. The metal core 42*a* includes, e.g., stainless steel or carbon steel. The elastic member 42*b* includes, e.g., solid or foam heat-resistant silicone rubber to cover the meal core 42*a*. The pressing roller 44 and the fixing roller 42 contact each other with pressure applied by the pressing roller 44, thereby forming a fixing nip N in a predetermined width. The fixing roller 42 has an outer diameter of from about 30 mm to about 40 mm. The elastic member 42*b* has a thickness of from about 3 mm to about 10 mm and a JIS-A hardness of from about 10° to about 50°.

Figure 3:
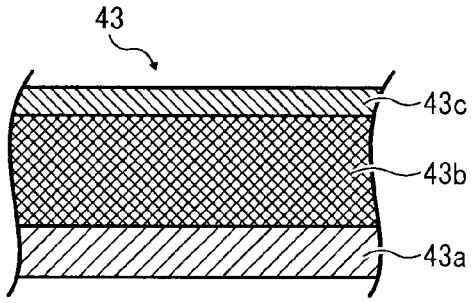
FIG. 3 is a cross-sectional view of a fixing belt included in the fixing device according to some exemplary embodiments of this disclosure.

The fixing belt 43 serving as a fixing member is stretched over the heating roller 41 and the fixing roller 42. The fixing belt 43 of the fixing device 40 according to some exemplary embodiments of this disclosure includes a substance 43*a*, an elastic layer 43*b*, and a release layer 43*c*. As illustrated in FIG. 3, the elastic layer 43*b* is stacked on the substance 43*a*, and the release layer 43*c* is stacked on the elastic layer 43*b*.

The substance 43*a* has characteristics such as a mechanical strength and flexibility when the fixing belt 43 is stretched, and heat resistance to withstand a fixing temperature. Since the heating roller 41 is inductively heated in the fixing device 40 according to some exemplary embodiments of this disclosure, the substrate 43*a* preferably includes an insulating heat-resistant resin material such as polyimide, polyimide-amide, polyether-ether ketone (PEEK), polyether sulfide (PES), polyphenylene sulfide (PPS), or fluorine resin. The substrate 43*a* preferably has a thickness of from 30 μm to 200 μm from a view point of heat capacity and strength.

The elastic layer 43*b* is employed to give flexibility to a surface of the fixing belt 43 to obtain a uniform image without uneven glossiness. Hence, the elastic layer 43*b* preferably has a JIS-A hardness of from 5° to 50° and a thickness of 50 μm to 500 μm. From a view point of heat-resistance at a fixing temperature, the elastic layer 43*b* includes, e.g., silicone rubber or fluorosilicone rubber.

The release layer 43*c* includes a material of, e.g., fluorine resin such as tetrafluoride ethylene resin (PTFE), tetrafluoride ethylene-perfluoroalkyl vinylether copolymer resin (PFA) and tetrafluoride ethylene-hexafluoride propylene copolymer (FEP), combinations of the foregoing resin materials, or heat-resistant resin in which the above-described fluorine resin is dispersed.

By coating the releasing layer 43*c* with the elastic layer 43*b*, releasing performance of toner can be enhanced without using silicone oil, thereby preventing paper dust from sticking to the fixing belt 43 and realizing an oil-less system. However, the resin having releasing performance does not typically have elasticity like a rubber material. Thus, if a thick release layer 43*c* is formed on the elastic layer 43*b*, flexibility of the surface of the fixing belt 43 might be lost to an extent, causing uneven glossiness. To obtain both the flexibility and releasing performance, the release layer 43*c* has a thickness of from 5 μm to 50 μm, and preferably from 10 μm to 30 μm.

A primer layer may be provided between the layers, when needed. A durable layer may be provided on an inner surface of the substrate 43*a* to enhance durability under a sliding condition.

Further, the substrate 43*a* may be preferably provided with a heat generating layer. For example, a layer made of copper having a thickness of from 3 μm to 15 μm may be formed on a base layer made of, e.g., polyimide to be used as a heat generating layer.

The pressing roller 44 includes a cylindrical metal core 44*a*, a high heat-resistant elastic layer 44*b*, and a release layer 44*c* to form the fixing nip N by pressing the fixing roller 42 via the fixing belt 43. The pressing roller 44 has an outer diameter of from about 30 mm to about 40 mm. The elastic layer 44*b* has a thickness of from about 0.3 mm to about 5 mm and an Asker hardness of from about 20° to about 50°. The elastic layer 44*b* includes a heat-resistant material such as silicone rubber. Additionally, the release layer 44*c* including fluorine resin and having a thickness of from about 10 μm to about 100 μm is formed on the elastic layer 44*b* to increase the releasing performance upon two-sided printing operation.

The pressing roller 44 is configured to press and engage with the fixing roller 42 via the fixing belt 43 by having hardness greater than the hardness of the fixing roller 42. Such an engagement gives a curvature to a recording medium enough to prevent the recording medium from being conveyed along the surface of the fixing belt 43 when exiting the fixing nip N. Thus, the releasing performance of the recording medium can be improved.

Figure 4:
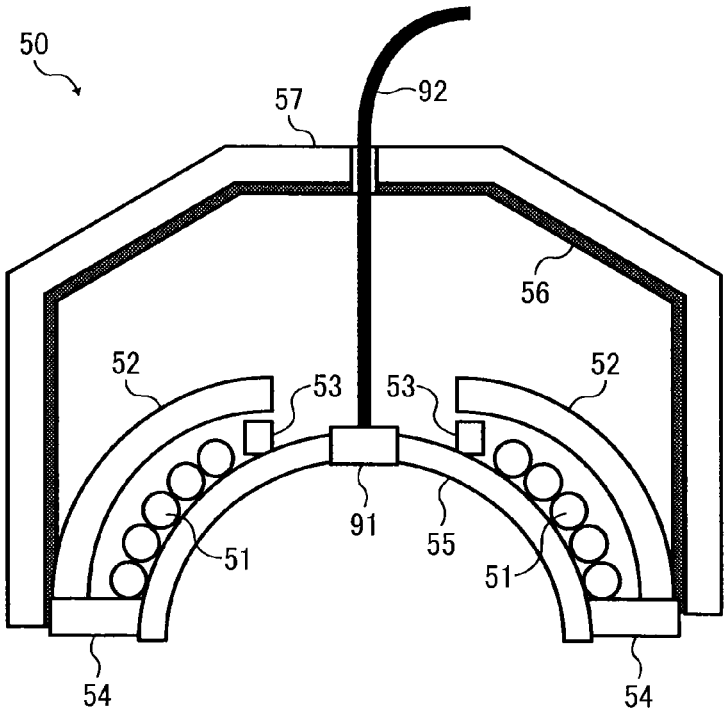
FIG. 4 is a cross-sectional view of an induction heating unit according to a first exemplary embodiment.

FIG. 4 is a cross-sectional view of an induction heating unit 50 included in a fixing device 40 according to a first exemplary embodiment of this disclosure.

Specifically, FIG. 4 illustrates a cross section of about a center of the induction heating unit 50 in a longitudinal direction thereof, that is, an axial direction of the heating roller 41, and the cross section is perpendicular to an axis of the heating roller 41. The induction heating unit 50 according to the first exemplary embodiment includes an excitation coil 51, multiple ferromagnetic cores such as arch cores 52, center cores 53 and side cores 54, a coil holder 55, an aluminum cover 56, and a resin cover 57.

The excitation coil 51 is prepared by winding up a Litz wire from 5 times to 15 times. The Litz wire includes from about 50 to about 500 conductive wires individually insulated and twisted together. Each conductive wire has a diameter of from about 0.05 mm to about 0.2 mm. A fusion layer is provided on a surface of the Litz wire. The fusion layer is stiffened by applying heat either by means of supplying power or in a thermostatic oven. Accordingly, a shape of the excitation coil 51 thus prepared can be maintained. Alternatively, the excitation coil 51 may be prepared by winding up a Litz wire without a fusion layer, and press-molding the wound Litz wire to provide a shape to the excitation coil 51. Resin having insulation performance and heat resistance, such as polyamide-imide or polyimide, is used as an insulation material to coat the Litz wire. According to the first exemplary embodiment of this disclosure, the cooling efficiency of the excitation coil 51 is increased. Therefore, the excitation coil 51 may include a material having a heat resistance lower than a heat resistance of a material of a typical excitation coil, such as polyester or polyester imide. The excitation coil 51 thus wound is glued to the coil holder 55 by, e.g., silicone glue. To obtain a heat resistance enough to withstand heat at a fixing temperature or higher, the coil holder 55 includes high-resistant resin such as polyethylene terephthalate (PET) or liquid crystal polymers.

Figure 5B:
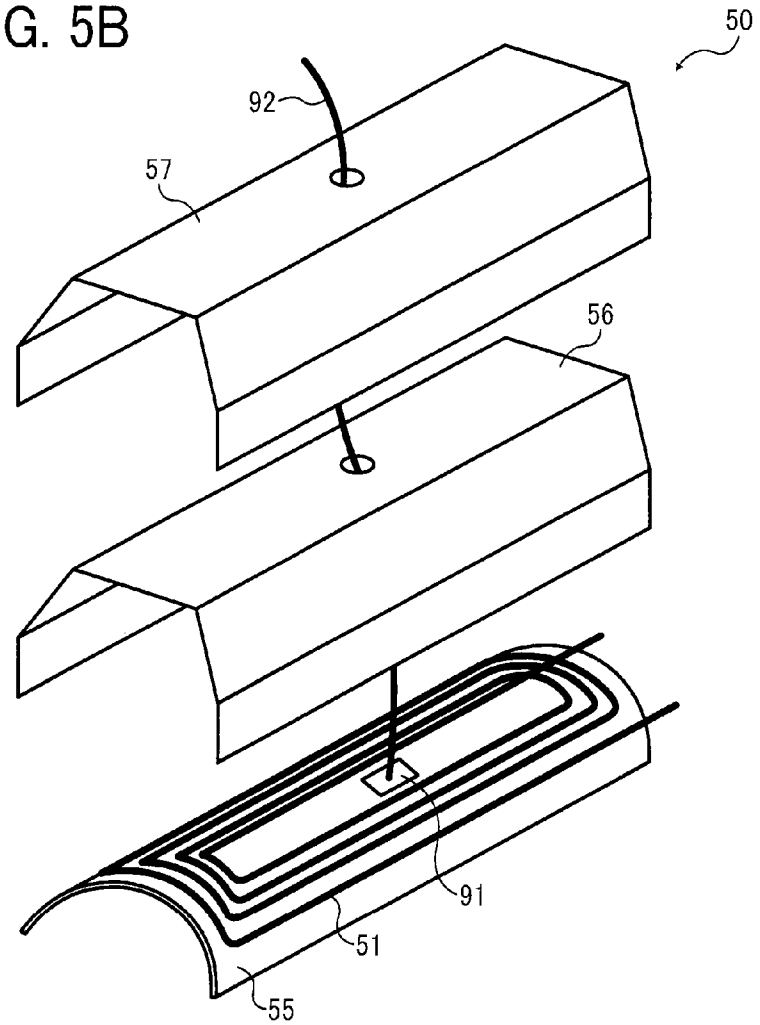
FIG. 5B is a perspective view of the induction heating unit in a decomposed state with the conductive wire according to the first exemplary embodiment.
Figure 5A:
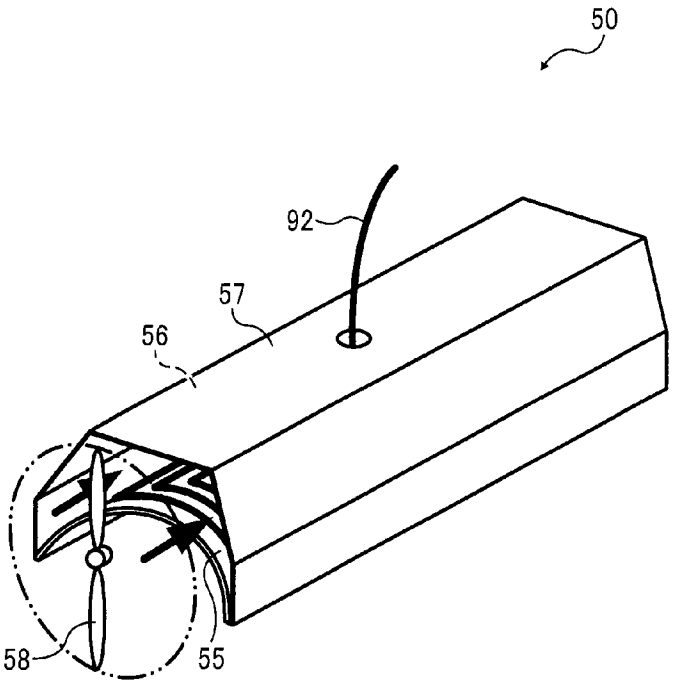
FIG. 5A is a perspective view of the induction heating unit in an assembled state with a conductive wire according to the first exemplary embodiment.
Figure 7A:
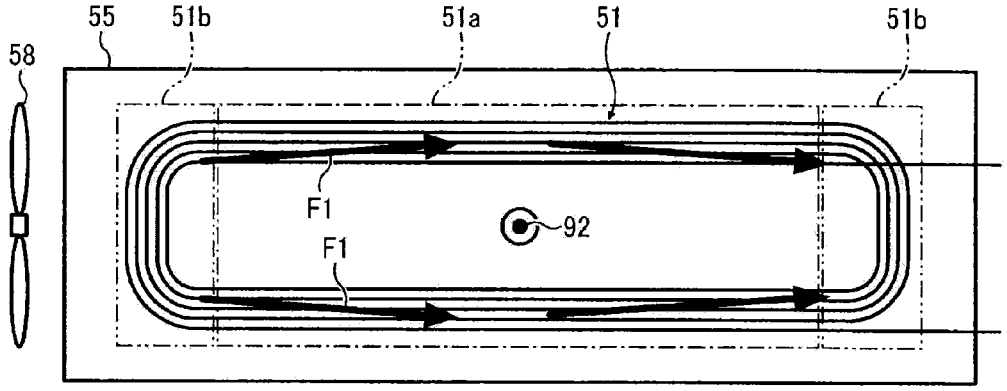
FIG. 7A is a schematic view of a current of cooling air flowing in the induction heating unit according to the first exemplary embodiment.
Figure 7B:
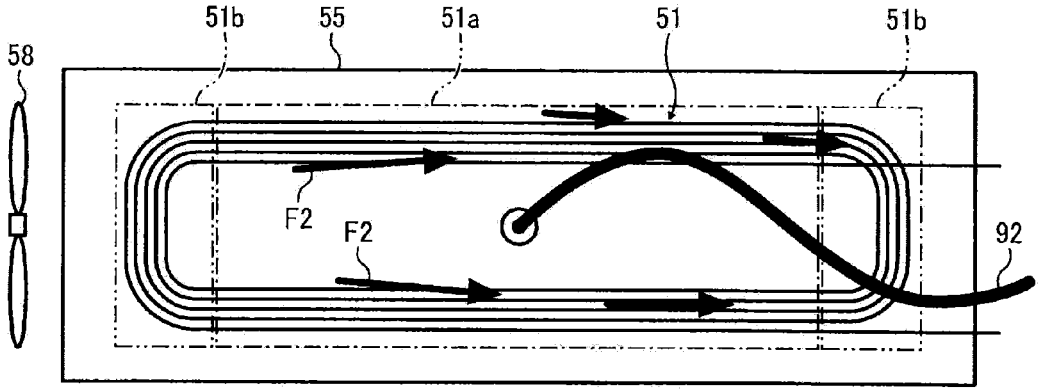
FIG. 7B Background Art
FIG. 7B is a schematic view of a current of cooling air flowing in the induction heating unit according to the comparative example 1.

Although the excitation coil 51 is illustrated in an elliptical or rectangle shape in FIGS. 5A and 5B for simplicity, the excitation coil 51 according to the first exemplary embodiment is configured by circulating a wire flux obtained by bundling up 90 insulated wires made of copper having an outer diameter of 0.15 mm. The excitation coil 51 thus configured is disposed, in a spiral manner, over an entire width of a surface of the coil holder 55 formed so as to cover the heating roller 41 serving as a heat generation member. The shape of the excitation coil 51 is obtained by winding up the Litz wire in a rotational axis direction of the heating roller 41 along an outer circumference of the fixing belt 43. It is to be noted that, as illustrated in FIGS. 7A and 7B, the excitation coil 51 includes a straight part 51*a* and connection parts 51*b*. The straight part 51*a* faces the heating roller 41 and is located in a middle of the excitation coil 51 in the rotational axis direction of the heating roller 41 (i.e., longitudinal direction of the induction heating unit 50). The connection parts 51*b* are located at both ends of the excitation coil 51 to be connected to the straight part 51*a*.

The ferromagnetic cores includes the arch cores 52, the center cores 53, and the side cores 54, and are provided so as to cover the excitation coil 51, thereby forming a magnetic path to direct magnetic flux arising from the excitation coil 51 to the heating roller 41. The arch cores 52 face a circumferential surface of the heating roller 41 and is disposed behind the excitation coil 51. The center cores 53 are mounted on the coil holder 55 inside the excitation coil 51 (i.e., on an inner circumferential side of the excitation coil 51) to support the arch cores 52. The side cores 54 face the circumferential surface of the heating roller 41 without the excitation coil 51 interposed therebetween, and are disposed closer to the heating roller 41 serving as a heat generating member than the arch cores 52. The ferromagnetic cores include soft magnetic materials with low coercivity and high permeability, and preferably have high electrical resistivity. Specific example materials of the ferromagnetic cores include, but are not limited to, a permalloy material and a ferrite material such as a Mn—Zn (manganese-zinc) ferrite material or a Ni—Zn (nickel-zinc) ferrite material.

It is to be noted that each of the center cores 53 and the side cores 54 is a plate-shaped core or a rod-shaped core extending in the longitudinal direction of the induction heating unit 50 (i.e., axial direction of the heating roller 41). On the other hand, each of the arch cores 52 is a core curved along the circumferential surface of the heating roller 41 as seen from the axial direction of the heating roller 41 as illustrated in FIG. 4. Multiple arch cores 52 are disposed with predetermined intervals therebetween in a longitudinal direction of the heating roller 41 to obtain uniform temperature distribution in the longitudinal direction of the heating roller 41.

As illustrated in FIG. 4 and FIG. 5B, the resin cover 57 is disposed on the aluminum cover 56 so that the aluminum cover 56 and the resin cover 57 cover the induction heating unit 50. The aluminum cover 56 has a function as an electromagnetic shield to shield electromagnetic waves arising from the excitation coil 51, thereby preventing components disposed around the excitation coil 51 from being heated due to the electromagnetic waves. Hence, the electromagnetic shield includes a nonmagnetic and conductive material. According to the first exemplary embodiment, the electromagnetic shield includes aluminum. Alternatively, the electromagnetic shield may include, e.g., copper, gold, or silver. The resin cover 57 is a housing of the induction heating unit 50. Hence, the resin cover 57 includes resin having high heat resistance such as polyethylene terephthalate (PET) or liquid crystal polymers. Each of the aluminum cover 56 and the resin cover 57 has a hole at a center thereof. As described later, a conductive thermostat wire 92 of a thermostat 91 is drawn out of the induction heating unit 50 through the holes.

As illustrated in FIG. 5A, a cooling fan 58 is provided at an end of the induction heating unit 50 in the longitudinal direction thereof to send air into a space between the coil holder 55 and cover members, that is, such as the aluminum cover 56 and the resin cover 57, thereby cooling down the excitation coil 51 that generates heat when the induction heating unit 50 is activated. According to the first exemplary embodiment, the cooling fan 58 is provided on a side face of the induction heating unit 50. Alternatively, a flow channel such as a duct may be provided between the induction heating unit 50 and the cooling fan 58 so that the cooling fan 58 cools down the induction heating unit 50 via the flow channel. It is to be noted that the fixing device 40 may have the cooling fan 58. Alternatively, the image forming apparatus 100 may include the cooling fan 58 to send cooling air into the induction heating unit 50.

As illustrated in FIG. 4, the thermostat 91 is mounted on the coil holder 55 of the induction heating unit 50 so as to fit in a hole provided in the coil holder 55. The thermostat 91 is located inside the excitation coil 51 (i.e., on an inner circumferential side of the excitation coil 51) and substantially in the middle in the axial direction of the heating roller 41. The thermostat 91 has a function as a temperature switch to block connection with a circuit (conductive wire) when a predetermined temperature is reached. In other words, the thermostat 91 has a function as a safety device to stop supplying power on detecting an abnormal increase in the temperature of the fixing device 40.

The conductive thermostat wire 92 is a conductive wire connected to the thermostat 91 to supply power to the thermostat 91. As illustrated in FIG. 4 and FIG. 5B, the conductive thermostat wire 92 is drawn out of the induction heating unit 50 through holes provided in the aluminum cover 56 and the resin cover 57. The conductive thermostat wire 92 is connected to a power source to supply power to the thermostat 91.

Figure 6B:
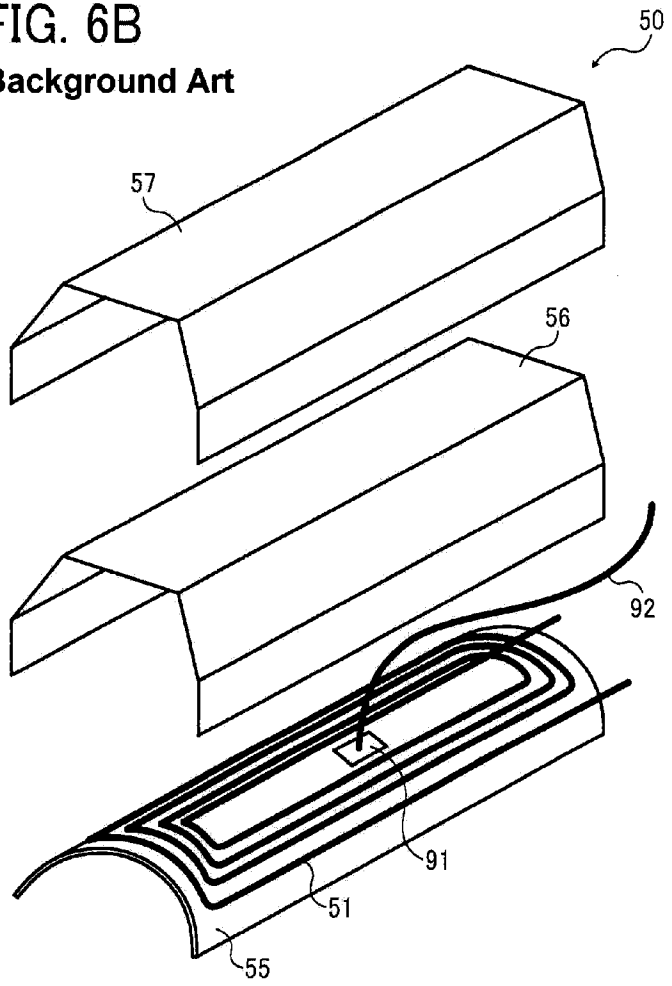
FIG. 6B Background Art
FIG. 6B is a perspective view of the induction heating unit in a decomposed state with the conductive wire according to the comparative example 1.
Figure 6A:
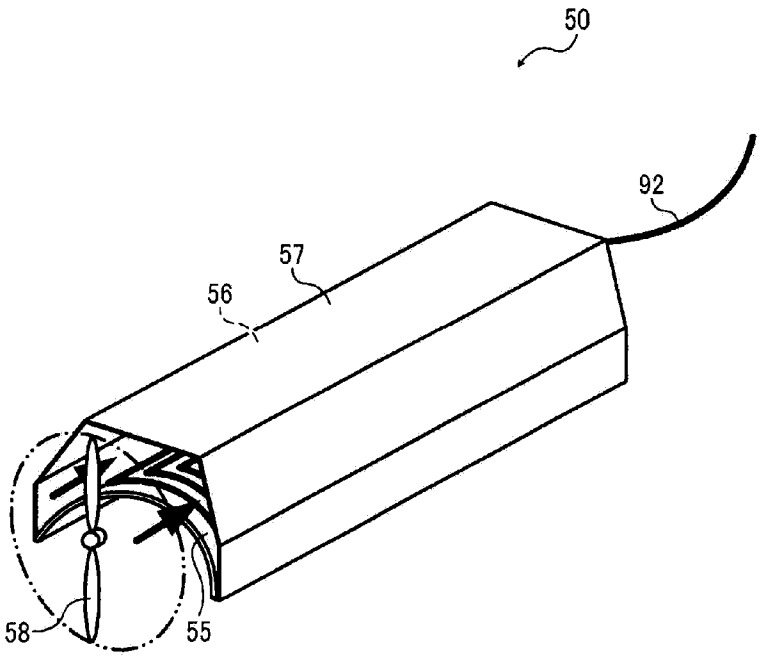
FIG. 6A Background Art
FIG. 6A is a perspective view of an induction heating unit in an assembled state with a conductive wire according to a comparative example 1.

A description is now given of a way of drawing a conductive thermostat wire 92 out of a induction heating unit 50 according to a comparative example 1 with reference to FIGS. 6A and 6B, in comparison with a way of drawing the conductive thermostat wire 92 out of the induction heating unit 50 according to the first exemplary embodiment illustrated in FIGS. 5A and 5B.

FIGS. 6A and 6B are explanatory diagrams illustrating how the conductive thermostat wire 92 is drawn out of the induction heating unit 50 according to the comparative example 1.

A basic configuration of the induction heating unit 50 according to the comparative example 1 illustrated in FIGS. 6A and 6B is similar to the basic configuration of the induction heating unit 50 according to the first exemplary embodiment illustrated in FIGS. 5A and 5B. Therefore, in FIGS. 5A, 5B, 6A, and 6B, the same reference numerals are used to refer to the same components.

FIGS. 5A and 6A are perspective views of the induction heating unit 50 in an assembled state with the conductive thermostat wire 92 according to the first exemplary embodiment and the comparative example 1, respectively. FIGS. 5B and 6B are perspective views of the induction heating unit 50 in a decomposed state with the conductive thermostat wire 92 according to the first exemplary embodiment and the comparative example 1, respectively. According to the first exemplary embodiment illustrated in FIGS. 5A and 5B, the conductive thermostat wire 92 passes through the holes provided in the aluminum cover 56 and the resin cover 57 toward an outside of the aluminum cover 56 and the resin cover 57, and is thus drawn out of the induction heating unit 50. By contrast, according to the comparative example 1 illustrated in FIGS. 6A and 6B, the conductive thermostat wire 92 passes through between the coil holder 55 and the aluminum cover 56 and is thus drawn out of the induction heating unit 50 from a downstream side of a current of cooling air flowing from the cooling fan 58.

FIG. 7A is a schematic view of a current of cooling air flowing in a direction indicated by arrows F1 (hereinafter referred to as cooling air current F1) in the induction heating unit 50 according to the first exemplary embodiment. FIG. 7B is a schematic view of a current of cooling air flowing in a direction indicated by arrows F2 (hereinafter referred to as cooling air current F2) in the induction heating unit 50 according to the comparative example 1. FIGS. 7A and 7B are top views of the coil holder 55 in which the excitation coil 51 is disposed.

According to the first exemplary embodiment, the conductive thermostat wire 92 is drawn out of the induction heating unit 50 through the holes provided in the aluminum cover 56 and the resin cover 57. Therefore, the conductive thermostat wire 92 does not significantly affect the cooling air current F1 in the induction heating unit 50. Accordingly, as illustrated in FIG. 7A, the cooling air flows downstream, that is, in the direction indicated by the arrows F1, without being disrupted by the conductive thermostat wire 92. As a result, the excitation coil 51 is efficiently cooled down.

By contrast, according to the comparative example 1, the conductive thermostat wire 92 is disposed between the coil holder 55 and the aluminum cover 56. Therefore, the conductive thermostat wire 92 disrupts the cooling air current F2 from the cooling fan 58, thereby reducing cooling efficiency.

Thus, compared to a typical configuration, such as the configuration of the induction heating unit 50 according to the comparative example 1, in which a conductive wire is disposed in a space in which an excitation coil 51 is wired, the cooling efficiency of the induction heating unit 50 is clearly improved according to the first exemplary embodiment of this disclosure, in which the conductive wire is drawn out of the cover members (i.e., the aluminum cover 56 and the resin cover 57) through the holes provided in the cover members.

Additionally, in the configuration of the induction heating unit 50 according to the first exemplary embodiment, the conductive thermostat wire 92 extends almost vertically from the thermostat 91 toward the holes provided in the cover members (i.e., the aluminum cover 56 and the resin cover 57). Accordingly, the cooling air current F1 from the cooling fan 58 hits the conductive thermostat wire 92 and is divided into two currents. Hence, as illustrated in FIG. 7A, the cooling air flows along the straight part 51*a* of the excitation coil 51 to efficiently cool down the excitation coil 51.

A description is now given of operation of the fixing device 40 configured as described above.

The fixing belt 43 rotates in a direction indicated by an arrow Y (i.e., counterclockwise direction) in FIG. 2. The heating roller 41 is heated by the induction heating unit 50. Specifically, by supplying a high-frequency alternating current in a range from 10 kHz (kilohertz) to 1 MHz (megahertz) to the excitation coil 51, magnetic lines are generated within a loop of the excitation coil 51 in a manner such that the magnetic lines alternately switch the direction thereof back and forth. An alternating magnetic field thus formed generates eddy currents and accordingly generates Joule heat on the heating roller 41. Thus, the heating roller 41 is heated by the induction heating. The heating roller 41 thus heated releases heat to the fixing belt 43. The fixing belt 43 thus heated contacts the sheet P conveyed at the nip N to heat and fuse the toner image on the sheet P.

Figure 8:
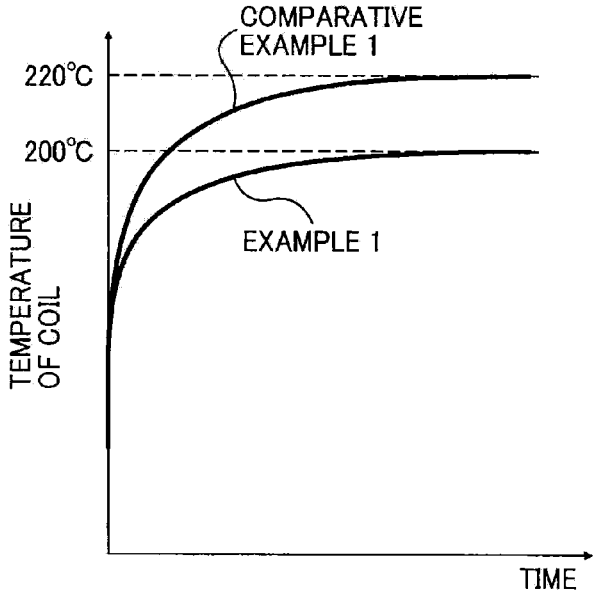
FIG. 8 is a graph of a transition of temperature of an excitation coil according to the first exemplary embodiment and a transition of temperature of an excitation coil according to the comparative example 1.

FIG. 8 is a graph of a transition of temperature of the excitation coil 51 during heating according to the first exemplary embodiment and a transition of temperature of the excitation coil 51 during heating according to the comparative example 1.

FIG. 8 shows a result of a comparative experiment with the configuration of the induction heating unit 50 according to the first exemplary embodiment illustrated in FIGS. 5A and 5B and the configuration of the induction heating unit 50 according to the comparative example 1 illustrated in FIGS. 6A and 6B, differing only in the way of drawing the thermostat wire 92 out of the induction heating unit 50. In the experiment, power was input to the excitation coil 51 to increase a temperature of the surface of the fixing belt 43 to a target temperature 170° C. A temperature of the excitation coil 51 was measured when the temperature of the surface of the fixing belt 43 reached 170° C. The temperature of the excitation coil 51 reached 220° C. in the configuration of the induction heating unit 50 according to the comparative example 1. By contrast, the temperature of the excitation coil 51 reached 200° C. in the configuration of the induction heating unit 50 according to the first exemplary embodiment. Thus, the temperature of the excitation coil 51 of the induction heating unit 50 according to the first exemplary embodiment was lower than the temperature of the excitation coil 51 of the induction heating unit 50 according to the comparative example 1 by 20° C. Accordingly, the cooling efficiency was clearly enhanced in the configuration of the induction heating unit 50 according to the first exemplary embodiment.

As described above, the first exemplary embodiment of this disclosure provides the fixing device 40 that can obtain an enhanced efficiency of cooling down the excitation coil 51 with a simple configuration and low production costs, without significantly changing a typical configuration of fixing device. Additionally, the cooling fan 58 operates at a lower power in a range of safety standards than a typical cooling fan because the fixing device 40 is configured to efficiently cool down the excitation coil 51. Accordingly, the fixing device 40 can effectively reduce production costs, power consumption, noises and/or the like.

It is to be noted that, because the fixing device according to some exemplary embodiments of this disclosure reliably improves efficiency of cooling down an excitation coil upon induction heating, components of the fixing device, such as a fixing member, a pressing member, and a heating member to heat the fixing member, may be configured in a different manner from the configurations illustrated in the accompanying drawings. For example, the fixing device may be configured to fix toner images onto a sheet of paper under heat and pressure at a nip formed between an endless, rotatable fixing member having flexibility and a pressing member facing, via the fixing member, a nip forming member provided in a loop formed by the fixing member, and the fixing member is provided with a heating member serving as a heat generating layer to be inductively heated. Alternatively, the fixing device may be configured to apply heat and pressure to a sheet of paper at a nip formed between a fixing roller serving as a fixing member and a pressing roller facing the fixing roller, and the fixing member is provided with a heating member serving as a heat generating layer to be inductively heated.

As described above, according to the first exemplary embodiment, the conductive thermostat wire 92 is drawn out of the induction heating unit 50 through the holes provided in the aluminum cover 56 and the resin cover 57. Additionally, any other conductive wires, such as a conductive wire of a temperature sensor and/or a conductive wire of an excitation coil 51, may be drawn out of the induction heating unit 50 through the holes provided in the aluminum cover 56 and the resin cover 57 to increase the efficiency of cooling down the excitation coil 51.

Operation of the cooling fan 58 causes the cooling air current F1 to cool down the excitation coil 51. As described above, a major portion of the conductive thermostat wire 92 is disposed outside the induction heating unit 50 by taking a short way through the holes provided in the aluminum cover 56 and the resin cover 57. In other words, a portion of the conductive thermostat wire 92, which is present in a space between the excitation coil 51 and the cover members (i.e., the aluminum cover 56 and the resin cover 57), is short to hardly disrupt the cooling air current F1 passing through in the space between the excitation coil 51 and the cover members. Such a configuration reduces disruption of the cooling air current F1 by the conductive thermostat wire 92, thereby increasing the efficiency of cooling down the excitation coil 51. Additionally, the cooling fan 58 can be designed to reduce its rotational speed, thereby saving energy.

It is to be noted that the fixing device 40 is connected to the thermostat 91 to prevent an excessive temperature rising of the fixing device 40. According to the first exemplary embodiment of this disclosure, the conductive thermostat wire 92 hardly disrupts the cooling air current F1 from the cooling fan 58 to efficiently cool down the excitation coil 51.

Additionally, the aluminum cover 56 having a function as an electromagnetic shield prevents components disposed around the excitation coil 51 from being heated due to electromagnetic waves in a simple configuration with low production costs.

A description is now given of a fixing device 40 according to a second exemplary embodiment of this disclosure.

The fixing device 40 according to the second exemplary embodiment is different from the fixing device 40 according to the first exemplary embodiment only in a shape of an aluminum cover 56, which is formed to allow conductive wires to pass through between the aluminum cover 56 and a resin cover 57 to be drawn out of an induction heating unit 50. Accordingly, redundant descriptions thereof are omitted unless otherwise required.

Figure 9B:
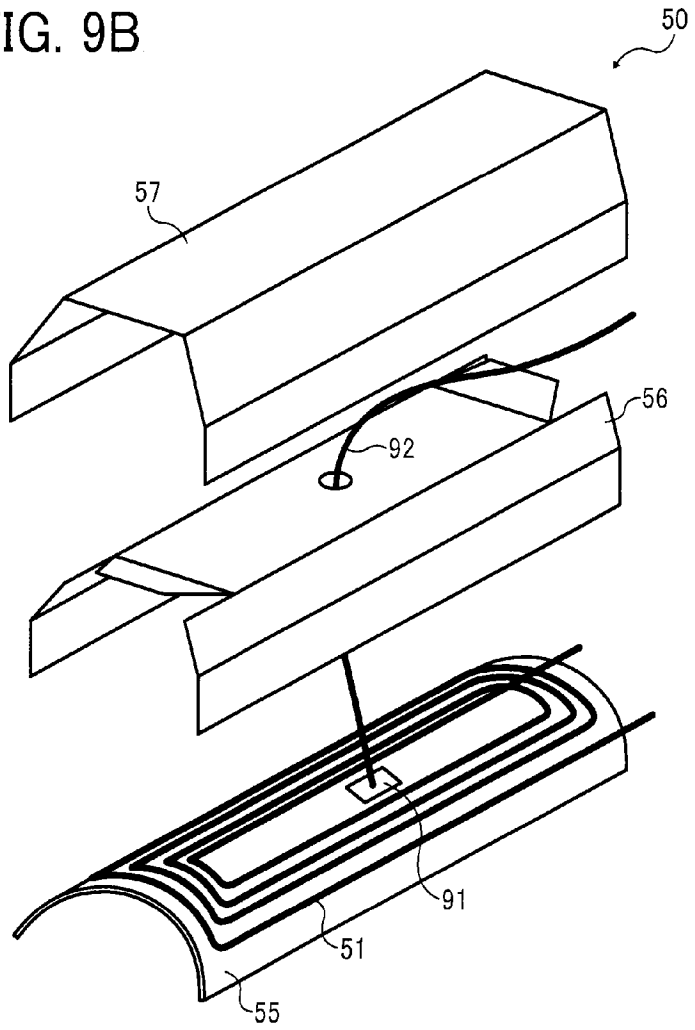
FIG. 9B is a perspective view of the induction heating unit in a decomposed state with the conductive wire according to the second exemplary embodiment.
Figure 9A:
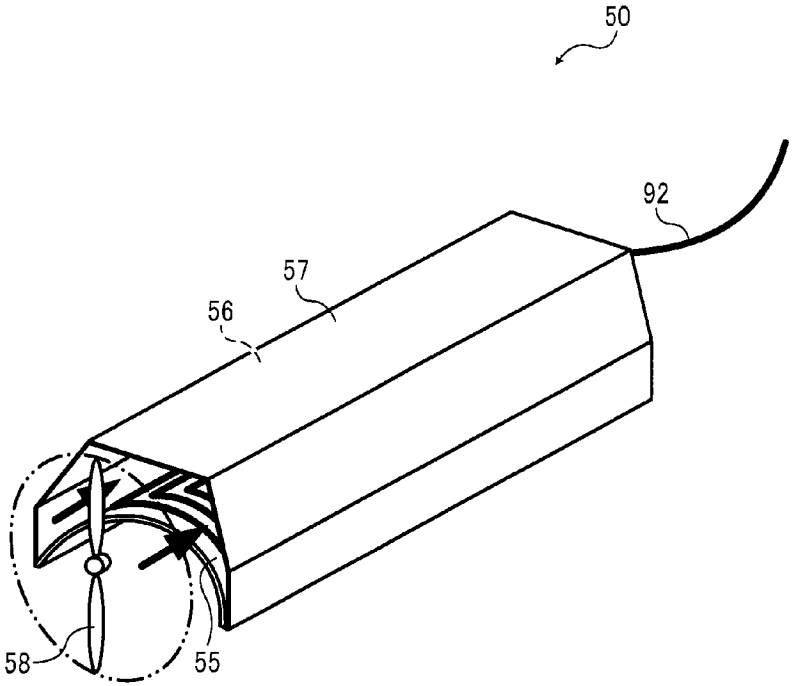
FIG. 9A is a perspective view of an induction heating unit in an assembled state with a conductive wire according to the second exemplary embodiment.

FIG. 9A is a perspective view of the induction heating unit 50 in an assembled state according to the second exemplary embodiment. FIG. 9B is a perspective view of the induction heating unit 50 in a decomposed state according to the second exemplary embodiment.

Figure 10:
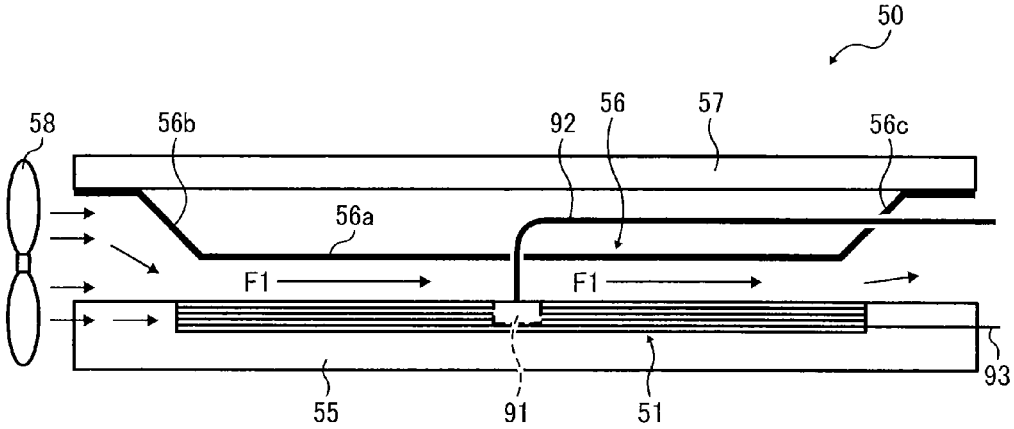
FIG. 10 is a schematic view of a current of cooling air flowing in the induction heating unit according to the second exemplary embodiment.

FIG. 10 is a schematic view of a cooling air current F1 in the induction heating unit 50 according to the second exemplary embodiment.

As illustrated in FIGS. 9B and 10, the aluminum cover 56 according to the second exemplary embodiment has a recessed portion 56*a* and end portions 56*b* and 56*c*. The aluminum cover 56 is recessed in a middle in a longitudinal direction thereof toward a coil holder 55 to form the recessed portion 56*a*, which is closer to an excitation coil 51 than the end portions 56*b* and 56*c*. Such a configuration of the aluminum cover 56 creates a space between the aluminum cover 56 and the resin cover 57. A conductive thermostat wire 92 passes through a hole provided in the aluminum cover 56 and then the space between the aluminum cover 56 and the resin cover 57 to be drawn out of the induction heating unit 50 from a downstream side of the cooling air current F1 from a cooling fan 58. It is to be noted that a clearance is provided in the end portion 56*c* of the aluminum cover 56 so that the conductive thermostat wire 92 is drawn out of the induction heating unit 50 through the clearance. A conductive wire 93 of the excitation coil 51 is also drawn out of the induction heating unit 50 from the downstream side of the cooling air current F1 from the cooling fan 58. The conductive thermostat wire 92 and the conductive wire 93 of the excitation coil 51 are collectively connected to an external power source.

As described above, according to the second exemplary embodiment, the aluminum cover 56 is recessed in the middle in the longitudinal direction thereof toward the coil holder 55 to form the recessed portion 56*a*. In such a configuration, a distance between the recessed portion 56*a* and the coil holder 55 is shorter than a distance between any other portion of the aluminum cover 56 and the coil holder 55. In other words, the aluminum cover 56 is closer to the coil holder 55 in the middle than in the ends. The distance between the recessed portion 56*a* and the coil holder 55 is from about 60% to about 80% of the distance between each of the end portions 56*b* and 56*c* and the coil holder 55. In such a configuration, the cooling air current F1 generated by operation of the cooling fan 58 increases its speed when passing through a narrower flow channel over the excitation coil 51. Accordingly, the efficiency of cooling down the entire excitation coil 51 can be increased.

Another effect is that the conductive thermostat wire 92 hardly disrupts the cooling air current F1 of from the cooling fan 58 because the conductive thermostat wire 92 is drawn toward the downstream side of the cooling air current F1. Accordingly, the cooling efficiency is improved. Further, the fixing device 40 according to the second exemplary embodiment can be smaller than the fixing device 40 according to the first exemplary embodiment because the conductive thermostat wire 92 is disposed in the space between the aluminum cover 56 and the resin cover 57, and thus the fixing device 40 according to the second exemplary embodiment obviates an extra space outside the induction heating unit 50 to wire conductive wires. Furthermore, by collecting the conductive wire of the excitation coil 51 and the conductive thermostat wire 92 drawn from the downstream side of the cooling air current F1 from the cooling fan 58, power can be supplied to a thermostat 91 and the excitation coil 51 with a simply configured circuit.

A description is now given of a fixing device 40 according to a third exemplary embodiment of this disclosure.

The fixing device 40 according to the third exemplary embodiment is different from the fixing device 40 according to the first exemplary embodiment only in that an induction heating unit 50 has a rib 59 serving as a rectifying member to divide a cooling air current F1 in the induction heating unit 50 into two currents and conductive wires are drawn out of the induction heating unit 50 through the rib 59. Accordingly, redundant descriptions thereof are omitted unless otherwise required.

Figure 11:
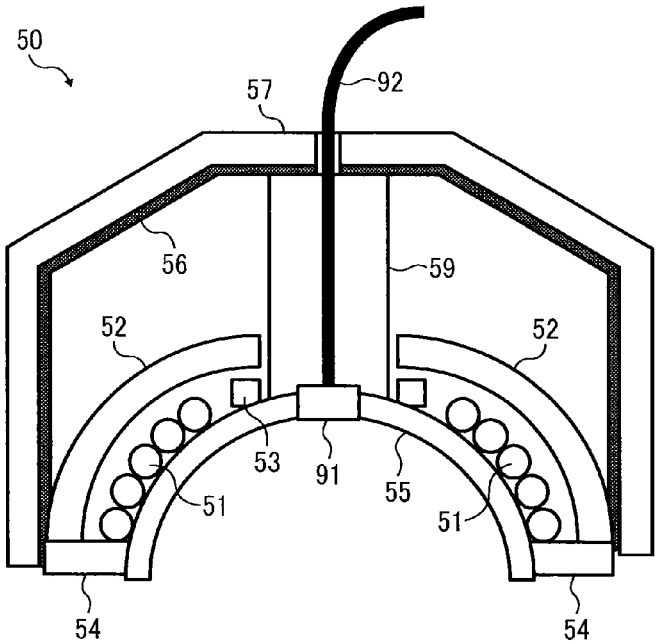
FIG. 11 is a cross-sectional view of an induction heating unit according to a third exemplary embodiment.

FIG. 11 is a cross-sectional view of the induction heating unit 50 according to the third exemplary embodiment.

Figure 12:
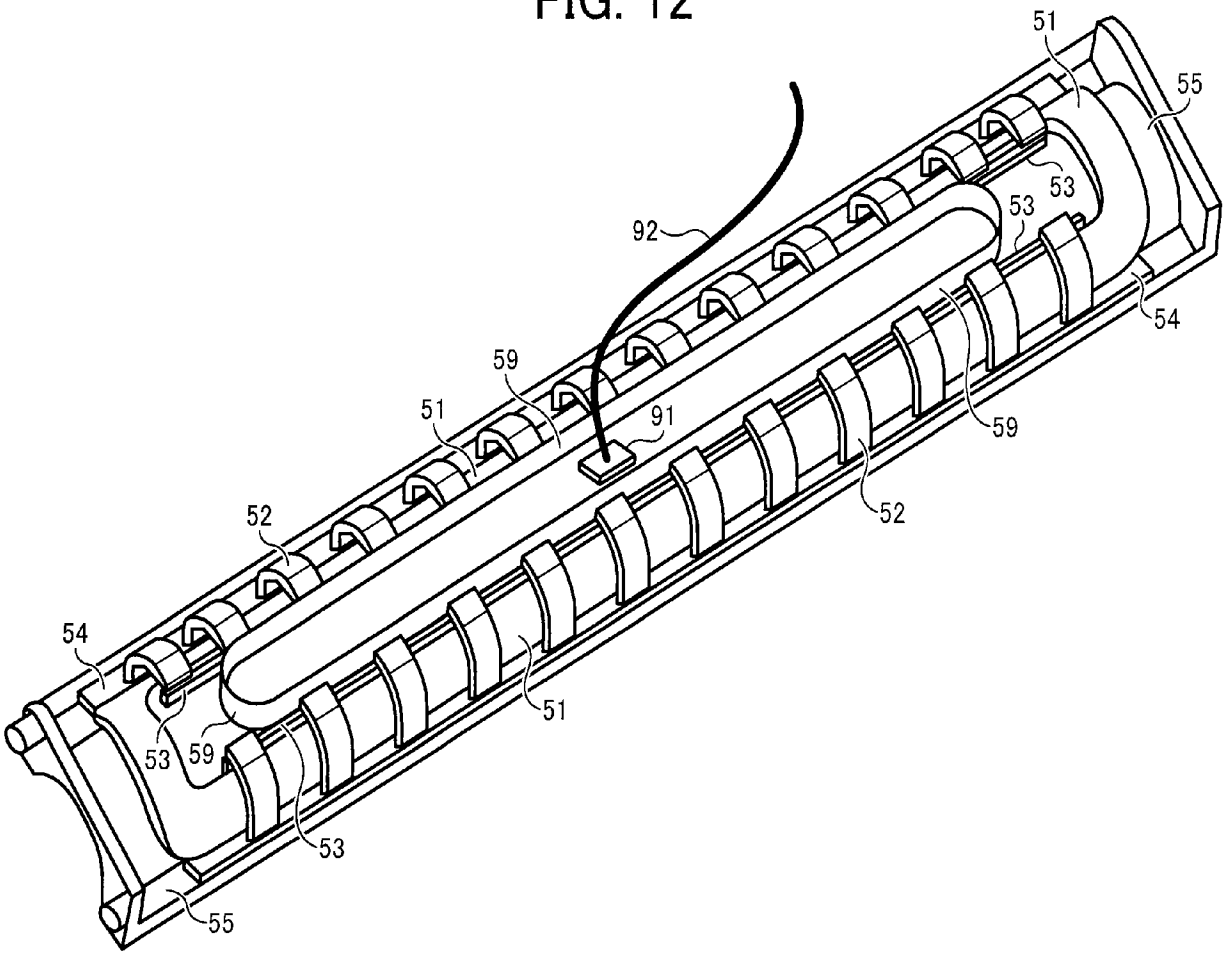
FIG. 12 is a perspective view of a part in which an excitation coil is disposed in the induction heating unit according to the third exemplary embodiment.

FIG. 12 is a perspective view of a part in which an excitation coil 51 is disposed according to the third exemplary embodiment.

Figure 13:
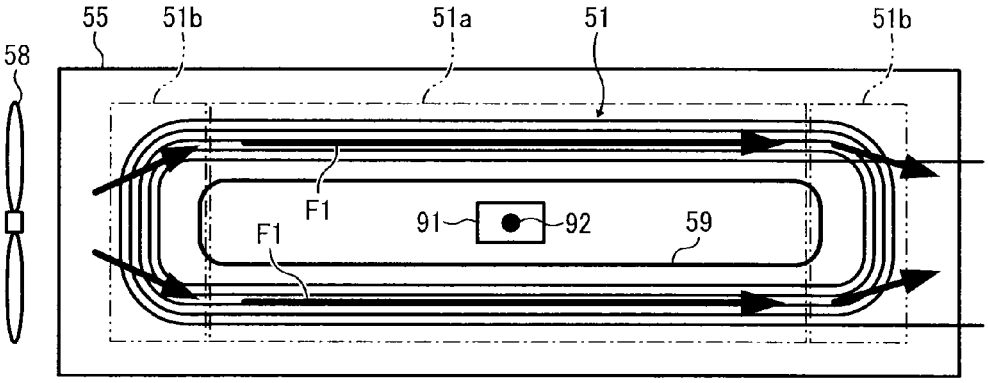
FIG. 13 is a schematic view of a current of cooling air flowing in the induction heating unit according to the third exemplary embodiment.

FIG. 13 is a schematic view of operation of cooling down the excitation coil 51 according to the third exemplary embodiment.

According to the third exemplary embodiment illustrated in FIGS. 11 through 13, the induction heating unit 50 has the rib 59 serving as a rectifying member inside the excitation coil 51 (i.e., on an inner circumferential side of the excitation coil 51) to divide the cooling air current F1 in the induction heating unit 50 into two currents. As illustrated in FIG. 11 and/or FIG. 12, the rib 59 has a wall shape and is provided between the center cores 53 so as to protrude upwardly from a coil holder 55 in FIG. 11, and to extend in a longitudinal direction of the induction heating unit 50 (i.e., an axial direction of a heating roller 41). Additionally as illustrated in FIG. 12 and/or FIG. 13, the rib 59 is provided so as to encompass an inside of the excitation coil 51 (i.e., a space defined on the inner circumferential side of the excitation coil 51). It is to be noted that, according to the third exemplary embodiment, the rib 59 is an integral part of the coil holder 55. Alternatively, the rib 59 may be an independent part from the coil holder 55.

A thermostat 91 is disposed inside the excitation coil 51 (i.e., on the inner circumferential side of the excitation coil 51). Specifically, the thermostat 91 is disposed inside the rib 59. A conductive thermostat wire 92 passes through an inside of the rib 59 and holes provided in an aluminum cover 56 and a resin cover 57 to be drawn out of the induction heating unit 50.

The rib 59 is a rectifying member to divide a space in which the excitation coil 51 is disposed into two spaces. Specifically, the space is defined between the coil holder 55 on which the excitation coil 51 is disposed and cover members of the induction heating unit 50, that is, the aluminum cover 56 and the resin cover 57. According to the third exemplary embodiment, the rib 59 includes liquid crystal polymers, which are also included in the coil holder 55. The rib 59 includes high-resistant resin such as polyethylene terephthalate (PET) or liquid crystal polymers. It is to be noted that the rib 59 may include a material having high heat conductivity to rectify an air current inside the induction heating unit 50 to increase cooling efficiency. The rib 59 including a material having high heat conductivity can facilitate heat release from the excitation coil 51 during operation. The rib 59 preferably has a flat surface to reduce fluid resistance. Accordingly, the rib 59 serving as a rectifying member may include, instead of the material used according to the third exemplary embodiment, a metal material, such as aluminum, cooper, or iron, a resin material having a flat surface, or the like.

A description is now given of effects obtained by providing the rib 59 in the induction heating unit 50 with reference to FIG. 13.

The rib 59 prevents the cooling air current F1 from a cooling fan 58 from passing through the inside of the rib 59 (i.e., inside of the excitation coil 51) to increase an amount of cooling air flowing along the excitation coil 51 (i.e., in the space in which the excitation coil 51 is wired). Such a configuration allows the cooling fan 58 to cool down the excitation coil 51 more efficiently than the cooling fan 58 according to the first exemplary embodiment. Another effect is that the rib 59 is configured to contact the aluminum cover 56 to support the aluminum cover 56 from below, as illustrated in FIG. 11, thereby increasing the strength of the induction heating unit 50 covered by the aluminum cover 56. According to the third exemplary embodiment, the rib 59 is provided in the induction heating unit 50 according to the first exemplary embodiment. Alternatively, the rib 59 may be provided in the induction heating unit 50 according to the second exemplary embodiment.

A description is now given of a fixing device 40 employing a heat-rolling system according to a fourth exemplary embodiment of this disclosure.

Figure 14:
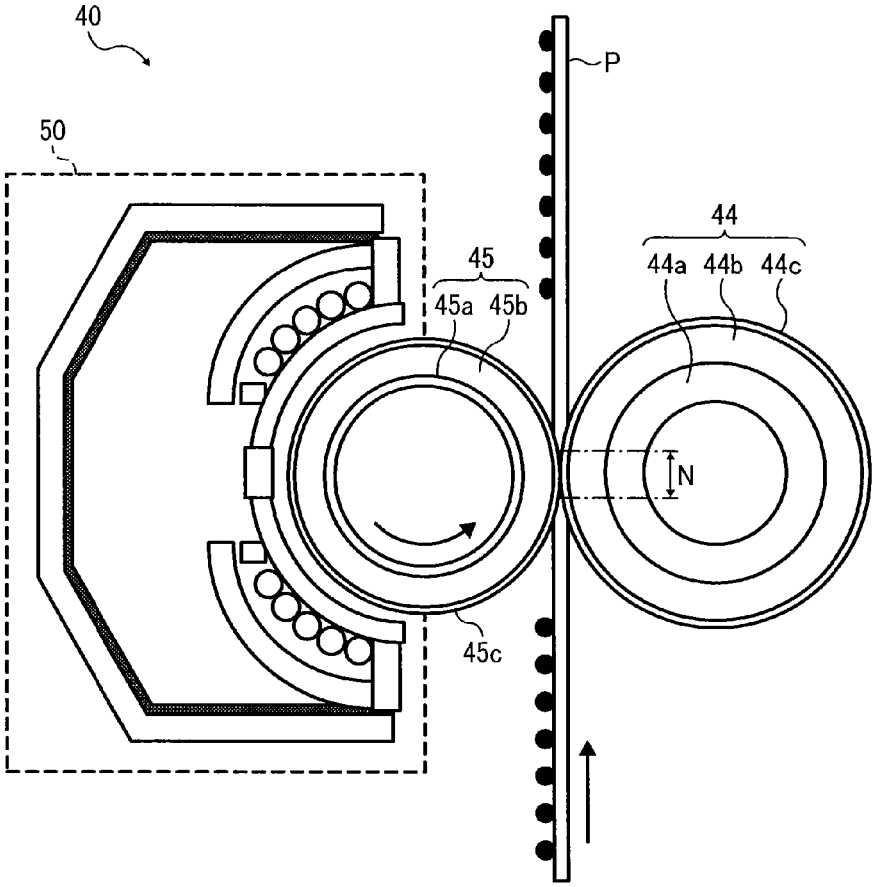
FIG. 14 is a cross-sectional view of a fixing device employing a heat-rolling system according to a fourth exemplary embodiment.

FIG. 14 is a cross-sectional view of the fixing device 40 employing a heat-rolling system, in which a fixing roller 45 serving as a fixing member is heated by an induction heating unit 50.

A configuration of the fixing device 40 of FIG. 14 is different from the configuration illustrated in FIG. 2 only in that the fixing roller 45 serves as a fixing member. It is to be noted that the fixing roller 45 serving as a fixing member also serves as a heat generating member to generate heat by being heated by the induction heating unit 50.

The configuration and operation of the induction heating unit 50 is the same as the configuration and operation of the induction heating unit 50 of the fixing device 40 illustrated in FIG. 2. The fixing device 40 illustrated in FIG. 14 can include the induction heating unit 50 according to each of the foregoing exemplary embodiments. Accordingly, redundant descriptions thereof are omitted.

In the fixing device 40 illustrated in FIG. 14, the fixing roller 45 has an outer diameter of from about 30 mm to about 40 mm. The fixing roller 45 includes, e.g., a metal core 45*a*, an elastic layer 45*b*, a heat generating layer 45*c*, and a release layer. The elastic layer 45*b*, the heat generating layer 45*c*, and the release layer are stacked on the metal core 45*a* in this order from the metal core 45*a*. The fixing roller 45 rotates in a counterclockwise direction in FIG. 14. The fixing roller 45 is inductively heated, and then heats and fuses a toner image formed on a sheet P conveyed.

As described above, some exemplary embodiments of this disclosure provide a fixing device (e.g., fixing device 40) including an induction heating unit (e.g., induction heating unit 50). The induction heating unit includes an excitation coil (e.g., excitation coil 51), a coil holder (e.g., coil holder 55), and cover members (e.g., aluminum cover 56 and resin cover 57). A conductive thermostat wire (e.g., conductive thermostat wire 92) is drawn from an inner circumferential side of the excitation coil to an outside of the induction heating unit through holes provided substantially at a center of the cover members in a longitudinal direction of the induction heating unit, and is then disposed outside the cover members. In such a configuration, the conductive thermostat wire hardly disrupts a current of cooling air (e.g., cooling air current F1) passing through inside the cover members to increase efficiency of cooling down the excitation coil. The fixing device also provides an enhanced cooling efficiency with a simple configuration and low production costs.

Such an enhanced cooling efficiency allows a fan unit (e.g., cooling fan 58) to be designed to reduce its rotational speed, thereby saving energy and minimizing noises.

One of the cover members serves as a shielding member (e.g., aluminum cover 56) to shield electromagnetic waves. The other cover member serves as a housing of the induction heating unit (e.g., a resin cover 57). The cover member having a function as an electromagnetic shield prevents components disposed around the excitation coil from being heated due to electromagnetic waves.

The conductive thermostat wire passes through the holes provided in the shielding member and the housing of the induction heating unit, and is then disposed outside the induction heating unit. Thus, the conductive thermostat wire can take a shortest way to be drawn out of the induction heating unit. Accordingly, the fixing device can realize improvement in the cooling efficiency with a simple configuration and low production costs.

One of the cover members has a recessed portion (e.g., recessed portion 56*a*), which is recessed toward the coil holder. Accordingly, a flow channel for the cooling air is narrowed to increase a flow speed of the cooling air, thereby further improving the cooling efficiency in the induction heating unit.

Additionally, the conductive thermostat wire is disposed in the recessed portion to be drawn out of the induction heating unit. Accordingly, the fixing device obviates an extra space to dispose the conductive thermostat wire outside the induction heating unit, thereby being downsized.

The induction heating unit includes a rectifying member (e.g., a rib 59) to divide a current of air flowing in the induction heating unit into two currents. Accordingly, the air can flow along the excitation coil in the induction heating unit, thereby further enhancing the cooling efficiency.

Additionally, the conductive thermostat wire passes through the rectifying member and then is disposed outside the induction heating unit. Accordingly, the conductive thermostat wire does not disrupt a current of cooling air flowing in the induction heating unit, thereby further improving the cooling efficiency.

The conductive thermostat wire of a thermostat (e.g., thermostat 91), which is provided to prevent a temperature of the fixing device from excessively rising, passes through the hole provided in at least one of the cover members. Accordingly, the conductive thermostat wire hardly disrupts the current of cooling air, thereby enhancing the cooling efficiency.

The conductive thermostat wire is drawn out of the induction heating unit from a downstream side of the current of cooling air, thereby smoothing the current of cooling air and thus improving the cooling efficiency.

The fixing device has the fan unit to cool down the excitation coil, thereby ensuring cooling down of the excitation coil that is configured to inductively heat a heat generating member.

It is to be noted that any other conductive wires may be drawn out of the induction heating unit in addition to the conductive thermostat wire. The conductive wires may include, e.g., the conductive wire of the excitation coil, and/or a conductive wire of a temperature sensor. The shapes and sizes of the cover members may be appropriately defined. The shapes and sizes of the recessed portion provided in one of the cover members and those of the rectifying member may be appropriately defined.

Further, it is to be noted that the fixing device and the image forming apparatus may be any fixing device and image forming apparatus as long as the induction heating unit according to some exemplary embodiments of this disclosure is applicable to the fixing device and the image forming apparatus. The image forming apparatus is not limited to a copier or a printer. The image forming apparatus may be a facsimile machine or a multifunction device having two or more of copying, printing, and facsimile functions.

The present invention has been described above with reference to specific exemplary embodiments. It is to be noted that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention. The number of constituent elements and their locations, shapes, and so forth are not limited to any of the structure for performing the methodology illustrated in the drawings.

What is claimed is:

1. A fixing device comprising:

a rotatable fixing member;

a pressing member to contact the fixing member with pressure to form a nip between the pressing member and the fixing member;

an induction heating unit disposed outside of the fixing member and serving as a heating source to heat the fixing member, the induction heating unit including an excitation coil, a coil holder to hold the excitation coil, and a cover member provided facing the coil holder with the coil holder interposed between the cover member and the fixing member, the cover member includes a shielding member to shield an electromagnetic wave arising from the excitation coil, and the coil holder, the excitation coil, and the cover member are arranged in this order relative to the fixing member; and a conductive wire drawn out of the induction heating unit to be disposed outside the cover member through a hole bored in the cover member and provided substantially at a center of the cover member in a longitudinal direction of the induction heating unit, wherein the induction heating unit includes at least one magnetic arch core, and the at least one magnetic arch core is disposed closer to the fixing member than the cover member is to the fixing member.

2. The fixing device according to claim 1, wherein the cover member includes a housing of the induction heating unit.

3. The fixing device according to claim 1, wherein the cover member has a recessed portion recessed toward the coil holder, and the conductive wire is disposed in the recessed portion to be drawn out of the induction heating unit.

4. The fixing device according to claim 1, further comprising a rectifying member to divide a current of cooling air flowing in the induction heating unit, wherein the conductive wire is disposed through the rectifying member.

5. The fixing device according to claim 1, wherein the conductive wire is a conductive wire of a thermostat.

6. The fixing device according to claim 1, wherein the conductive wire is drawn out of the induction heating unit from a downstream side of a current of cooling air flowing in the induction heating unit.

7. The fixing device according to claim 1, further comprising a fan unit to cool down the excitation coil.

8. An image forming apparatus comprising the fixing device according to claim 1.

9. The fixing device according to claim 1, wherein the hole passes through the shielding member.

10. The fixing device according to claim 1, wherein a passage is formed between the cover member and the coil holder through which cooling air passes.

11. The fixing device according to claim 2, wherein at least a portion of the shielding member contours the housing of the induction heating unit.

12. The fixing device according to claim 1, wherein the cover member is separate from a magnetic core of the induction heating unit.

13. The fixing device according to claim 1, wherein a magnetic arch core of the induction heating unit is interposed between the cover member and the excitation coil.

14. The fixing device according to claim 1, wherein the shielding member is made of aluminum.

15. The fixing device according to claim 1, wherein the conductive wire is connected to a thermostat, and the thermostat is mounted on the coil holder and opposes an outer surface of the fixing member.

16. The fixing device according to claim 1, wherein the coil holder is disposed facing the fixing member, and the coil holder, the excitation coil, and the cover member are arranged in this order relative to the fixing member in a normal direction away from an outer circumferential surface of the fixing member, in a cross-sectional view.

17. The fixing device according to claim 1, further comprising a rib that divides a current of cooling air flowing in the induction heating unit into two currents.

18. The fixing device according to claim 17, wherein the rib extends in the longitudinal direction of the induction heating unit.

19. The fixing device according to claim 17, wherein the rib is provided in a space defined on an inner circumferential side of the excitation coil.

20. The fixing device according to claim 17, wherein the rib is an integral part of the coil holder.

* * * * *